US005544784A

United States Patent [19]

Malaspina

[11] Patent Number: 5,544,784

[45] Date of Patent: Aug. 13, 1996

[54] RECHARGEABLE BATTERY VENDING MACHINE

[75] Inventor: Francis P. Malaspina, Gainesville, Ga.

[73] Assignee: Motorola, Inc., Schaumburg, Ill.

[21] Appl. No.: 451,594

[22] Filed: May 26, 1995

[51] Int. Cl.[6] ..... A24F 27/14

[52] U.S. Cl. ..... 221/135; 221/97

[58] Field of Search ..... 221/92, 66, 123, 221/124, 135, 97, 98–100, 268, 277, 263; 320/2, 4

[56] References Cited

U.S. PATENT DOCUMENTS 3,171,568 3/1965 Arwine ..... 221/135
4,823,984 4/1989 Ficken ..... 221/97

*Primary Examiner*—Kenneth Noland
*Attorney, Agent, or Firm*—Kenneth M. Massaroni; Scott M. Garrett

[57] ABSTRACT

A vending machine (10) for vending a rechargeable battery pack has a interface unit (12), new battery reservoir (14), battery dispensing unit (16), and a control unit (18). A customer interested in purchasing a new battery insets a payment in the money handling unit (30). A display (32) is provided and prompts the customer for a response. The customer responds by use of an entry pad (3), and the machine dispenses a new battery. Alternatively, if the customer is interested in exchanging a discharged battery for a fully charged one of similar condition, a battery pack received unit (20) is provided with a receiver port (42) for the customer to insert the spent battery. The spent battery is quickly analyzed by a battery test unit (22) and assigned a grade. If the spent battery is in usable condition, it is passed to a battery recharger, and the customer is prompted to choose between a new battery and one of similar grade to that deposited. If a new battery is selected, one is dispensed, as before. If a similar battery is requested, then one is located in the recharged battery reservoir (26), and dispensed. The price charged to the customer is proportional to the difference in grade between the battery deposited and the battery dispensed. If the battery is in an unusable condition, the customer may choose to have it returned, or may choose for the machine to retain the battery in an internal recycle bin so that the battery may be collected for recycling. Additionally, the machine may have a communications relay station mounted on it for short range wireless communications systems.

18 Claims, 7 Drawing Sheets

10

RECHARGEABLE BATTERY VENDING MACHINE

TECHNICAL FIELD

This invention relates in general to vending machines and more particularly to vending machines for rechargeable batteries.

BACKGROUND OF THE INVENTION

Portable personal communications technology has expanded to a large segment of the world's population. Evidence of this is the widespread use of cellular phones, pagers, and portable computers. As such, there is an increasing demand for advanced power sources and associated technologies. One problem in particular is the need for accessible recharging capability. Some communications device users carry spare fully charged batteries whenever they expect to be away from wired communications for an extended period because it would be an inconvenience to carry a battery charger and wait for a battery pack to be recharged. Despite the simplicity of this solution, there are many users who often find themselves with a discharged, or "dead", battery pack. Having a spare battery pack could resolve their dilemma, but the cost of purchasing an additional battery pack may be prohibitive. In some cases, the user may have not planned adequately, and did not bring a spare battery pack.

A solution to this would be to design the devices to use primary battery cells instead of rechargeable battery cell packs. Primary cells are sold at many convenient locations, and are even sold through vending machines. They are more easily disposed of, and the price of a set of primary cells is significantly less than the price of a rechargeable battery pack. Despite the apparent attractiveness of this approach, it is not used because the long term cost associated with replacement of primary cells is far greater than the cost of a rechargeable battery pack. This is the reason why cellular phones are almost exclusively designed for use with rechargeable batteries.

A solution to this dilemma must involve convenient access to either recharged batteries, a battery charger, or a combination of both. It would certainly be possible to sell fully charged rechargeable batteries in airports, hotels, and shopping centers, but the customer would still have to pay the full price of the battery pack. However, were battery chargers located in such places, the customer would only have to pay for the energy to recharge the battery pack, and maybe an access fee. In this case, the customer would have to be willing to wait for the battery pack to be recharged. An ideal solution, then, is to combine these two ideas and provide a battery pack exchange. The customer gives up their spent battery pack, and providing it is in usable condition, receives a fully charged battery pack for a small fee. Certainly it would be a simple task to start such a business, but the slim profit margins would significantly deter a manned type of business. An approach similar to that used to vend canned beverages would be a more likely means of fulfilling the need.

At the same time, as the demand for portable communications devices increases, the number of relay stations will likely increase as well. The types of service provided by current systems may not be necessary for all markets. Some customers may only need infrequent use of a communications system. As an example, second generation cordless telephones, or CT2, provides a more limited type of communication service than existing cellular systems, but at a much reduced cost. These systems can provide a customer with the ability to make wireless public phone calls when located in proximity to a relay station, and are typically located in places such as shopping centers or airports.

Therefore there exists a need to provide a vending machine for rechargeable batteries whereby a spent battery pack may be exchanged for a recharged or new battery pack. Further, there exists a need for a conveniently located communications relay station. These two types of devices may be combined to fulfill both needs.

DETAILED DESCRIPTION OF THE PREFERRED EMBODIMENTS

Figure 1:
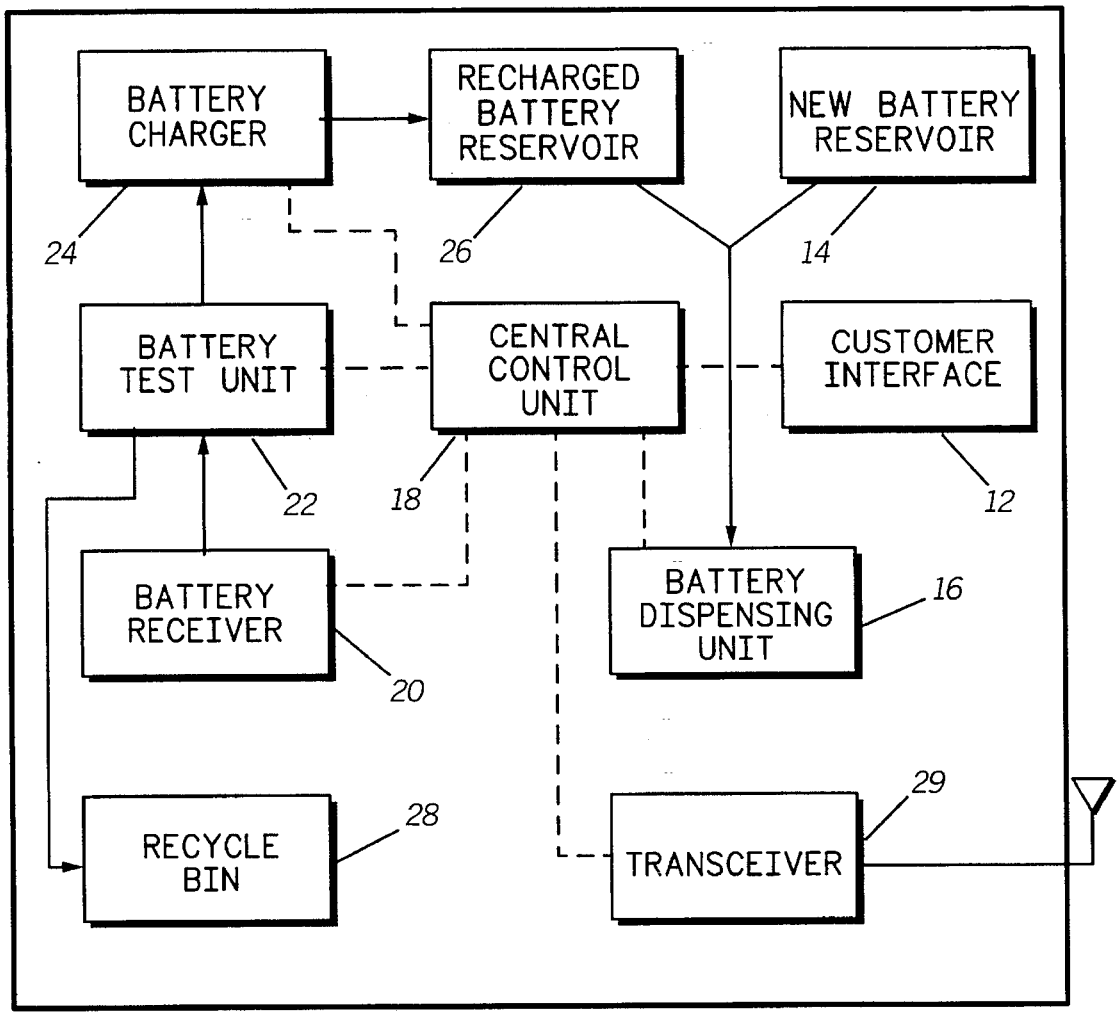
FIG. 1 is a block diagram of a vending machine system in accordance with the invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, where there is illustrated therein a block diagram of a rechargeable battery vending machine 10 for vending a rechargeable battery pack. Included in the system is a interface unit 12, new battery reservoir 14, battery pack dispensing unit 16, and a control unit 18. The interface unit 12 lists, or otherwise displays a set of alternative actions the vending machine 10 can take, and has a selection entry system and a means for receiving a payment. The control unit 18 preferably has a memory, at least a portion of which contains instruction code for operating the vending machine 10. Specifically, control unit 18 monitors the interface unit 12 for payment and selection information, processes the information, and controls other system components as directed by the instruction code in the memory of the control unit 18. The new battery reservoir 14 is a battery pack storage space for battery packs that have never been used, i.e., new battery packs. These battery packs are dispensed by the battery pack dispensing unit 16, as directed by the control unit 18, with a battery pack handling mechanism as shown in FIG. 1.

Alternatively, a customer may be interested in exchanging a discharged battery pack for one of similar condition that is fully charged, or for a new fully charged battery pack. To accommodate this, the machine includes a battery pack receiver unit 20, battery test unit 22, and a battery charger 24. The battery pack receiver unit 20 accepts the spent battery pack from the customer and delivers it to the battery test unit 22. The test unit 22 evaluates the received battery pack by checking such parameters as voltage, and response to a load, and generates test information which is signaled to the control unit 18. Once the control unit 18 determines the battery to be in useful condition, it is passed to the battery charger 24, a recharging device, where it is recharged. Upon being recharged the recharged battery pack is passed to a recharged battery reservoir 26 which is a battery pack storage space. The recharged battery pack's type, grade, and location is logged into the memory of the control unit 18. Additionally, the system has an internal bin 28 for storing batteries with no remaining useful life, so that they may be collected for recycling. As may be appreciated from FIG. 1, the central control unit is connected directly to the dispensing unit, the customer interface, the battery charger, the battery test unit, and the battery receiver.

Since vending machine 10 is likely located in areas with a high amount of human traffic, i.e., airports, shopping malls, etc., it lends itself well as a platform for a short range wireless communications relay station allowing two way wireless communication. Accordingly, a wireless communications transceiver 29 may be included. The transceiver 29 receives and transmits signals to personal communications devices in the immediate vicinity, and establishes a link between such devices and a communications infrastructure, such as the telephone system. The transceiver 29 also receives information from the control unit 18, such as when the vending machine 10 may need servicing, which can be communicated to a central office. Examples of such communications systems include second generation cordless phones (CT2) and "talk back" pager systems.

Figure 2:
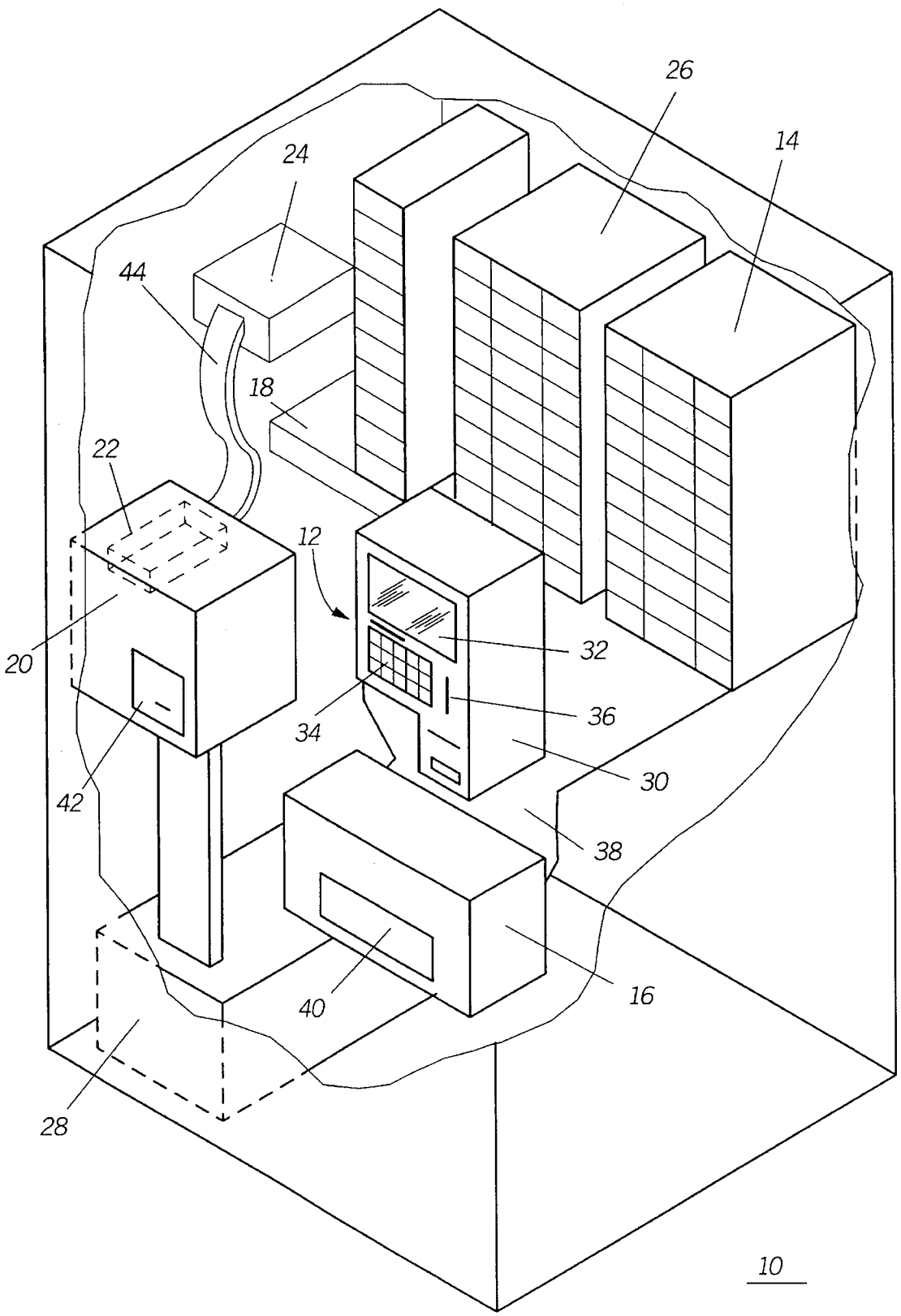
FIG. 2 is a perspective cutaway view of a vending machine in accordance with the instant invention.

Referring now to FIG. 2, where there is shown therein a perspective, partial cutaway view of a vending machine 10 in accordance with the instant invention. The system components described in FIG. 1 are shown here with the same reference numerals. Certain details, such as wiring between components, is not shown for clarity, and since such detail would be within the ordinary skill in the art. The interface unit 12 includes a money handling unit 30, a display 32, and an input means such as entry pad 34 for generating selection information. The display 32 and entry pad 34 are used for displaying a list of alternative operations the vending machine may perform and selecting one of the alternatives. These functions may be embodied by anything from large buttons with signs or pictures of the alternatives, as in canned beverage vending machines, to a cathode ray tube (CRT) display or a touch screen display CRT. The preferred means is to provide an electronic display, such as an LED or LCD panel, or the previously mentioned touch screen display, and a keypad. The LED panel displays information the control unit 18 sends, which then monitors the keypad for selection information. To make a selection the customer actuates the input device according to the desired action.

A customer desiring a new battery would activate the system by inserting a form of payment, which may be cash, credit card, or a debit card, thereby generating payment information. The credit or debit cards may be accommodated by a card reader 36. The payment information would be sent to the control unit 18, and the system would then wait for a response from the customer through a selection entry means, such as a keypad. Upon a positive response from the customer, the control unit 18 would direct the battery dispensing unit 16 to dispense a new battery. The battery dispensing unit 16 includes a battery handler 38 to move batteries from one of the battery reservoirs 14 or 26 to a battery delivery port 40, where the customer can receive the battery. The battery handler 38 may be a conventional conveyor as is known in the art.

If the customer is interested in exchanging a spent battery for one of similar condition that is fully charged, or for a new, fully charged battery, the customer would, as before, activate the machine via the interface unit 12, and insert the spent battery into battery pack receiver unit 20. The machine would prompt the customer to insert the spent battery into the battery pack receiver unit port 42. The battery would then be analyzed and graded by the test unit 22 located in the battery pack receiver unit 20, and adapted to carry out the analysis as described above. If the battery is in good condition it would be transferred to the battery charger 24 by a second battery handler 44, and the grade of the battery recorded in a non-volatile memory. At the same time the system would prompt the customer for an action; dispense a new battery, one of similar condition, or dispose of the original battery if it had no useful life left. If the customer desires a new battery, one would be dispensed from the new battery reservoir 14. If the customer desires a similar battery, with a similar grade and type it may be selected from the recharged battery reservoir 26 and dispensed to the customer. A similar battery will require only the cost of the recharge energy, while a new battery will require more money, depending on the condition of the received battery. In some cases, the customer may not need another battery and simply wish to dispose of the spent battery in a safe manner by depositing it with the machine for recycling, for which a recycling fee may be charged. The battery to be recycled may be delivered to a recycling bin 28 for later collection.

The components of the system are enclosed in a housing. The housing may be relatively large, approximating the size of common vending machines for canned beverages. Alternatively smaller units may be contemplated for different applications. The machine has an external power cable for connecting to an electrical power source, such as a common 120 VAC or 220 VAC outlet. The housing has a door on the front portion of the machine, as is common on vending machines, and is lockable. When the door is unlocked and opened, the machine is serviceable; money may be removed, batteries may be removed or added, and any repairs can be made.

Figure 3:
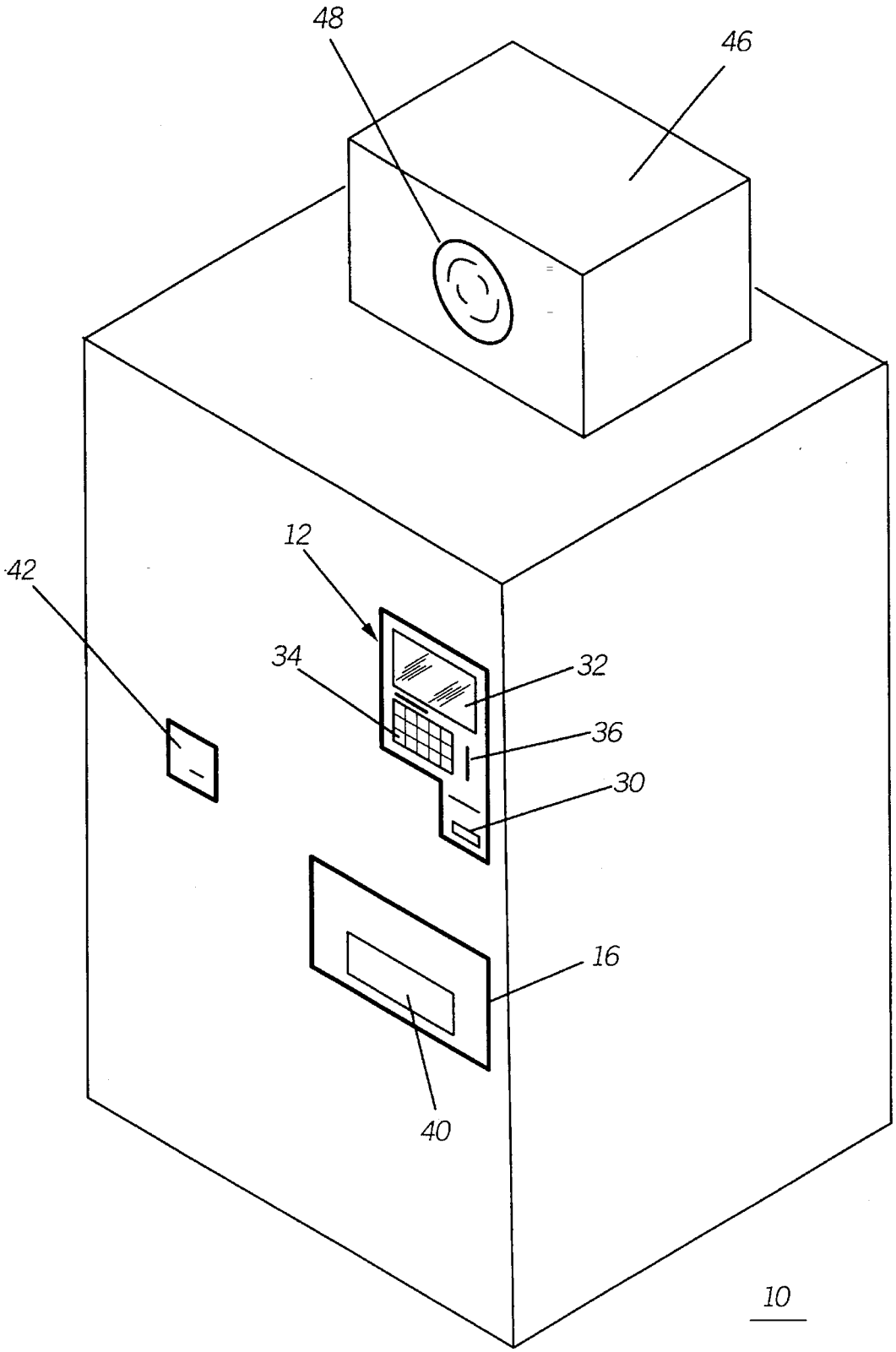
FIG. 3 is a perspective view of a vending machine including a communications relay station in accordance with the instant invention.

Referring now to FIG. 3, where there is illustrated therein a perspective view of the external appearance of a vending machine 10, as shown in FIG. 2, and further comprising a communications relay station 46. The relay station 46 has an antenna 48 for receiving and transmitting short range communications signals. The antenna 48 can be mounted internal or external to the machine. Also shown here are the external portions of several other elements; interface unit 12, battery pack dispensing unit 16, money handling unit 30, display 32, entry pad 34, card reader 36, battery pack delivery port 40, and battery pack receiver port 42.

Figure 4:
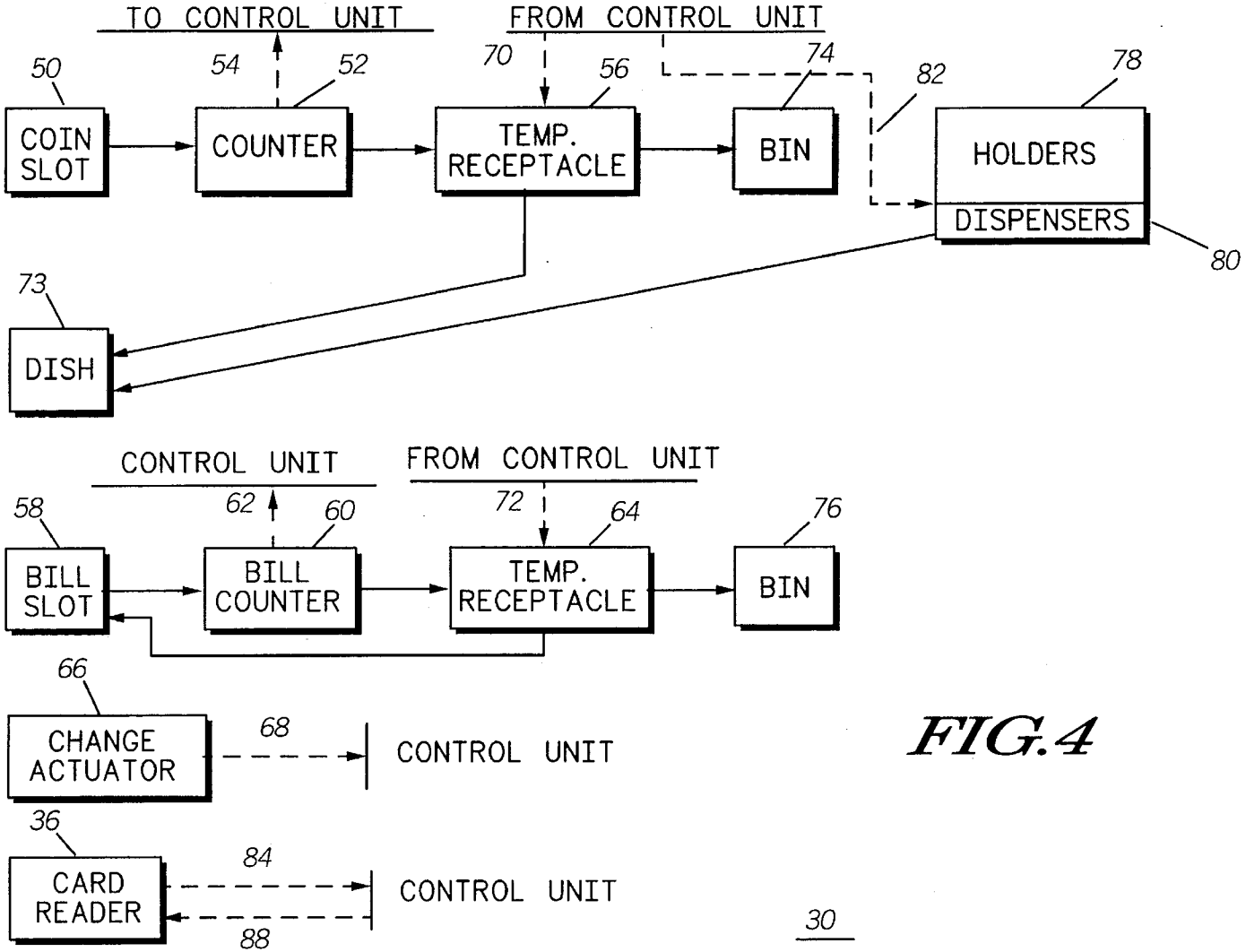
FIG. 4 is a block diagram of a currency handling sub-system for use with a vending machine in accordance with the invention.

Referring now to FIG. 4, there is illustrated therein a block diagram of illustrating a money handling unit 30. The money handling unit 30 comprises a coin slot 50 which allows coins to be inserted by the customer and delivers coins to the coin counter 52. The coin counter 52 is responsive to the type of coin deposited and sends a signal to the control unit 18 via line 54 informing it of the denomination of a deposited coin. The coins are then held in a temporary receptacle 56 until the transaction is complete.

For larger denominations, currency in the form of bills may be deposited with the machine as payment. A bill is inserted into a bill slot 58 and passed to a bill counter 60. The bill counter determines the denomination of the bill by any number of well known techniques and sends a signal to the control unit 18 via line 62, which keeps a count of the total amount of money deposited. The bill is then held in a temporary receptacle 64, as with coins, until the transaction is complete.

If at any time the customer decides to terminate the transaction, a simple lever, button, or other means is provided as a change actuator 66. The change actuator sends a signal to control unit 18 via line 68 once actuated. The control unit 18 then sends a signal to the temporary receptacles 56 and 64 via lines 70 and 72 respectively so that the machine may refund any coins or bills held in their respective temporary receptacles 56 and 64. Coins are dropped into a coin dish 73 and bills are returned via the bill slot 58.

Once the transaction is complete, the coins and bills are dropped into their respective bins 74 and 76 where they are held until the machine is serviced. Any over payment is then refunded to the customer. A series of coin holders 78 are provided to hold coins of different denominations. Each coin holder has a dispenser 80 which is responsive to the control unit 18 via a signal on line 82. The control unit 18 calculates the amount to be refunded and actuates the dispensers 80 accordingly. The dispensers drop coins from their respective holders into the coin dish 73 which is externally accessible by the customer.

Optionally, as shown in FIG. 2, a card reader 36, as for credit or debit cards is included to simplify payment. Credit card readers are well known and used in applications including public telephones and gasoline service pumps. A customer simply inserts the card, which is then read. Data and control signals are moved over lines 84 and 88. As money is received, either currency or by means of a card, payment information is generated which is signaled to the control unit 18. Once the transaction is decided upon, the control unit 18 authorizes billing to the credit account via a telephone line (not shown) provided to the machine. When the transaction is complete, or if for some reason can't be completed, the card is returned to the customer. The card reader, as well as the coin and bill slots, are well known in the art and are commonly practiced in many other applications.

Figure 5:
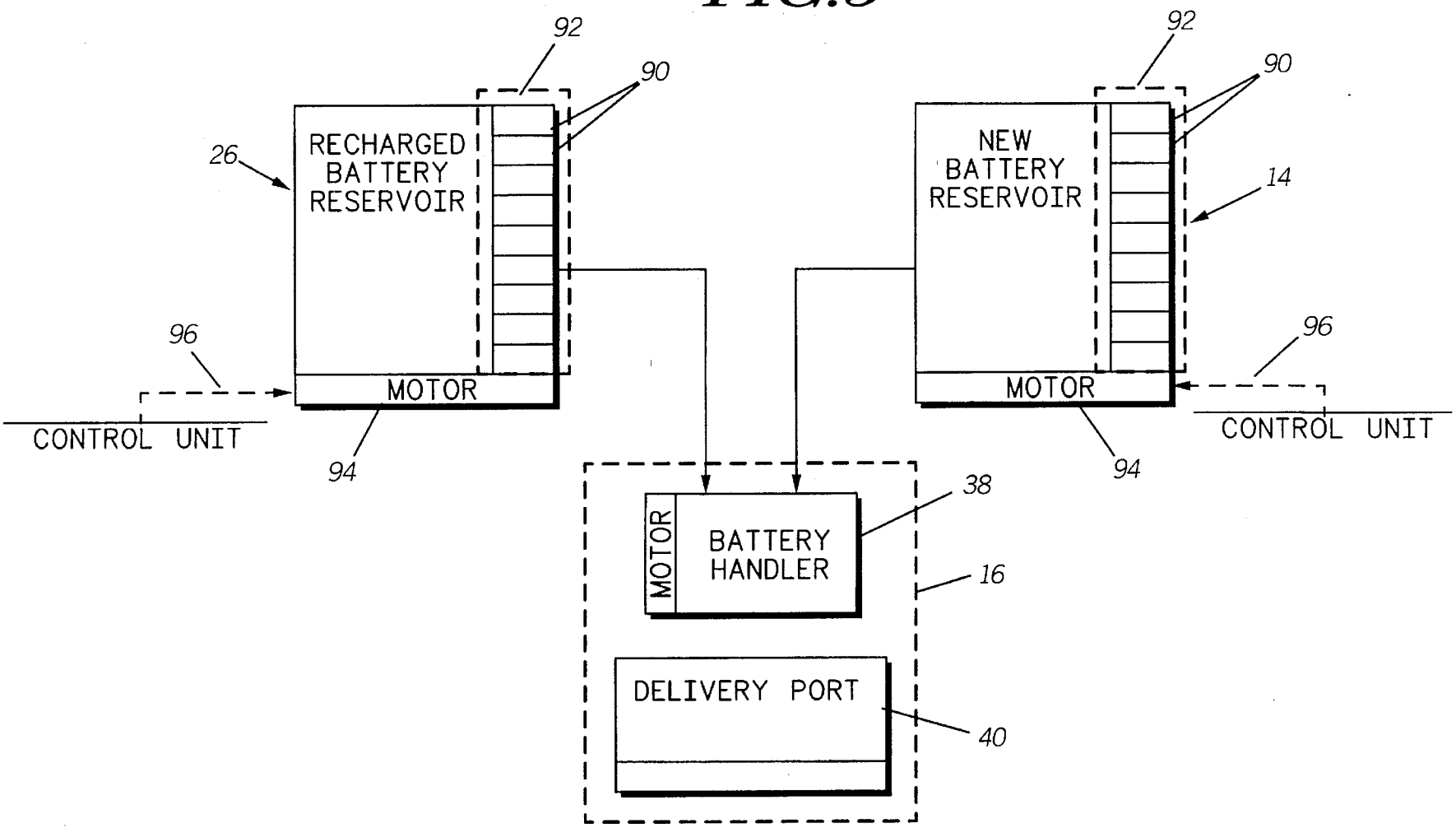
FIG. 5 is a block diagram of a battery pack dispensing sub-system for use in a vending machine in accordance with the invention.

Referring now to FIG. 5, where there is shown a block diagram of the machine's (10) means for dispensing a battery. The new battery reservoir 14, battery dispensing unit 16, recharged battery reservoir 26, battery handler 38, and battery delivery port 40 are all as described above. The battery reservoirs 14 and 26 are storage spaces, and hold various types of batteries in at least one, and preferably a plurality of compartments 90 until such time as they need to be vended to a customer. Compartments may be stacked forming a stack 92 in each reservoir, which can be raised or lowered by a motor unit 94 responsive to control signals sent via lines 96 from control unit 18. When a battery is to be dispensed, the control unit 18 decides from which compartment 90 the battery will be dispensed, and raises or lowers the stack 92 until a desired battery is aligned and corresponds with the battery handler 38. Once aligned, the battery is moved from it's compartment 90 to the battery handler 38. This may be accomplished by a variety of devices, though in a preferred embodiment, a simple pusher device (not shown) behind the stack 92 pushes a battery into the battery handler 38.

Alternatively, only one reservoir is employed. New batteries and recharged batteries are stored together, and the control unit 18 maintains a directory in memory of what type of battery is located in each battery compartment. When a customer makes a selection, the appropriate battery is located and dispensed. It is to be noted that while a single stack 92 is illustrated, a plurality of stacks, forming a row and column matrix may be provided. Of course the motor 95 must then be adapted to move the stacks horizontally as well as vertically.

The battery handler 38 may be a motorized unit which carries the battery to the delivery port 40, but is preferably a chute which guides the dispensed battery to the delivery port 40. The delivery port 40 comprises a simple bin with a door moveable by the customer, and may have a motorized door which opens once the dispensed battery is located in the bin, and closes when the customer removes the dispensed battery. Numerous delivery systems are currently employed by an automatic teller and vending machines, and the technology associated with them is easily applicable here.

Figure 6:
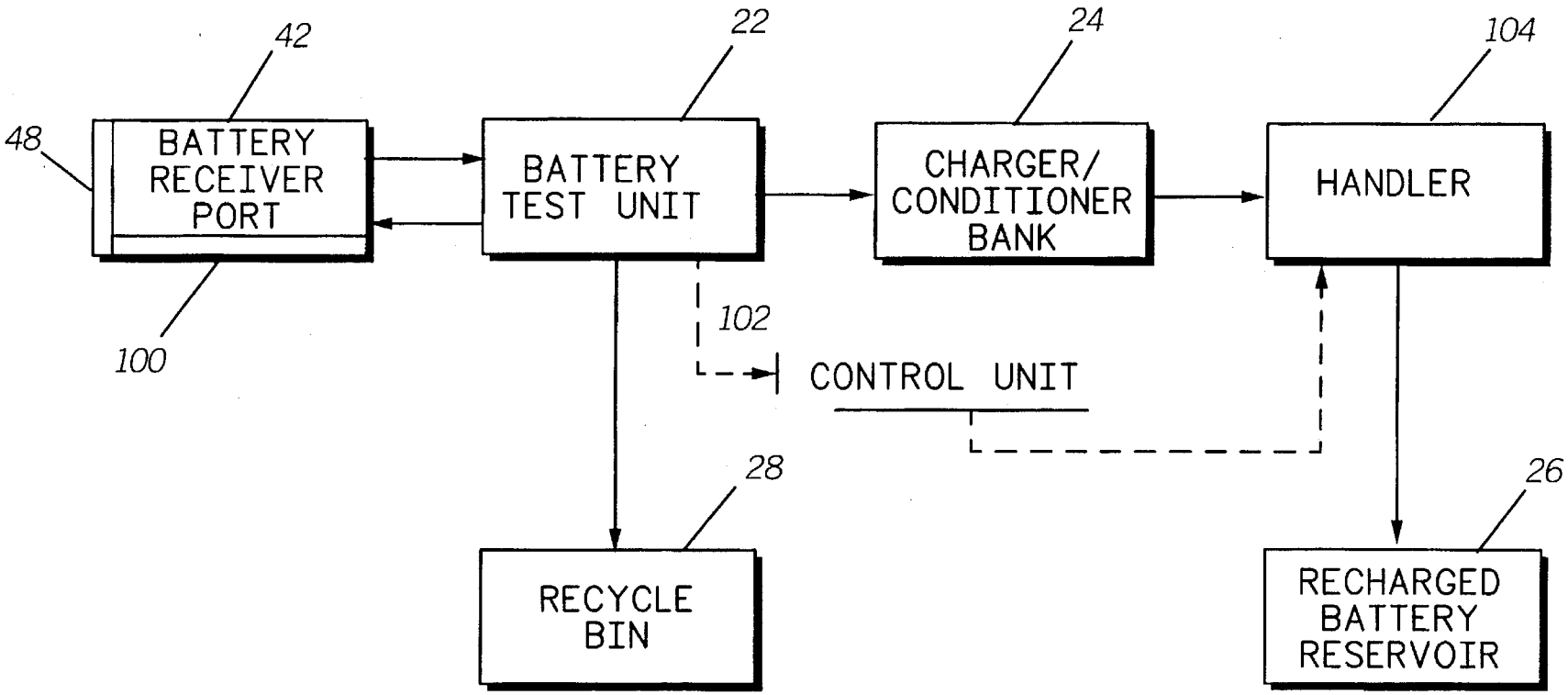
FIG. 6 is a block diagram of a battery pack receiving system for use with a vending machine in accordance with the invention.

Referring now to FIG. 6, where there is illustrated therein a block diagram of the mechanics for accepting a received battery from a customer in accordance with the invention. Elements previously described included here are battery pack receiver unit port 42, battery test unit 22, battery charger unit 24, and battery recycle bin 28. A customer wishing to exchange a spent battery for a fully charged one, or dispose of a unserviceable battery would activate the machine as previously described, and select the appropriate action.

The battery pack receiver unit port 42 has a door 48 that is preferably motorized and lockable so as to resist tampering. The machine would open the door 48, thereby exposing a battery holder 100. If the system is intended to handle more than one type of battery, then the appropriate holder corresponding to the battery, as selected by the customer, would be presented.

Once the battery has been inserted into the holder 100, the machine must ascertain the condition of the battery. There are a number of ways, from a system perspective, to allow for this. The machine could provided with a voltage measurement means and a load that can be switchably applied and the machine would perform a series of diagnostic tests, such as measuring the battery's impedance and it's response to a load. Alternatively, the battery could have a memory device for storing cycle history and other data useful for grading the battery. A third alternative would be to provide the battery with a feature that precludes them from being charged by any other device. Such a feature could be mechanical, electronic, or a combination of both. The battery could further be provided with an external identifier, such as a bar code, so that it can be tracked by a central computer system. When the customer inserts the battery, its identification is determined and matched to a history file stored a central computer.

Whatever the strategy of determining the battery's condition, once the battery is inserted into the holder 100, the battery may be moved to a separate test unit, but preferably, the holder 100 is connected to the test unit 22. The test unit 22 signals information to the control unit 18 via line 102. The information sent includes relevant battery information, some examples of which may include voltage, response to a load, manufacturing information, or capacity, and combinations thereof. This information allows the control unit 18 to assign a grade to the battery, which is then displayed to the customer. If the battery is unserviceable, the customer may choose between receiving the battery back from the machine, or depositing it for recycling. The battery is then passed to a charger unit 24 by a battery handling unit, as shown in FIG. 2. Since there is a finite amount of time required to charge a battery, usually 15–60 minutes, it is preferred that there are several such charging stations available. A plurality of charging stations would allow multiple batteries to be recharged simultaneously. Each charger would have its own power regulator to adjust current and voltage to match recommended charge regimes. The instructions for such regimes may be stored in a semiconductor memory in the control unit 18, or each charger unit may have its own memory. Regardless, the control unit polls the chargers at regular intervals to determine when to end the charge cycle.

Additionally, the charging stations may comprise circuitry to recondition the battery when possible. The condition of a battery may be improved by applying a series of controlled charge/discharge cycles. There are currently a number of devices commercially available that perform such a function. Since a battery conditioner requires both charge and discharge capability, and the charge capability is already provided, a discharge regulator must be provided to achieve battery conditioning capability.

Once a battery has been fully charged it is moved from the charger 24 to the recharged battery reservoir 26, by way of a handler 104. The handler 104 is directed by the control unit 18 to place a recharged battery into a specific compartment of the recharged battery reservoir 26. The control unit 18 stores the relevant data in memory, and preferably a non-volatile memory.

In order to move batteries from any one of a number of charging stations to any one of a number of compartments of the recharged battery reservoir 26, the handler 104 has at least a portion that can move in two dimensions. This portion would comprise a battery grasper assembly to grasp the battery while it is moved. The grasper assembly is mounted to a pair of perpendicularly disposed rods and is moveable on the rods by means of motors controlled by the control unit 18. The motors reel wires or cables connected to the assembly in the desired direction to produce the necessary X–Y motion. This means of achieving X–Y motion is well known and used in a variety applications, examples of which include leadless circuit board assembly and drawing plotters.

Figure 7:
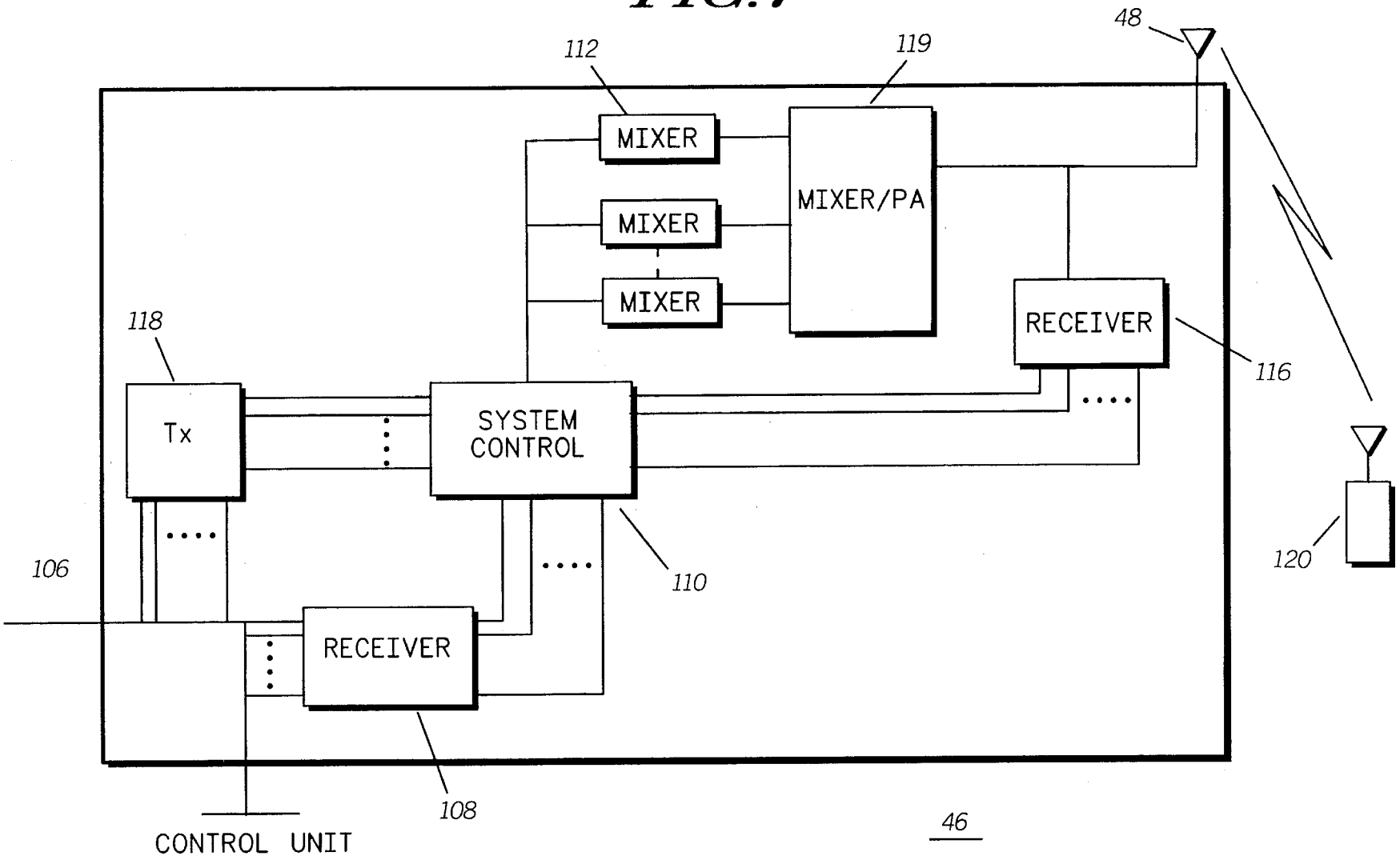
FIG. 7 is a block diagram of a short range wireless communications transceiver for use with a vending machine in accordance with the invention.

Referring now to FIG. 7, where there is illustrated a block diagram of a communications base station 46 in accordance with an alternate preferred embodiment of the instant invention. Telephone lines 106 are brought into the unit and shared with the control unit 18 of the vending machine. A receiver 108 receives communications signals from the telephone lines 106 and conditions the signals. The conditioned signals are fed to a system control 110 where they are coordinated with their respective conversation channels by sending the signal to a mixer 112 of the proper frequency. If the signal is a new signal, then it is assigned to the next available mixer 112. Once the signals are mixed and modulated to the correct frequencies, they are fed to a wide band mixer 114 which provides a power amplification function. The output of the wide band mixer 114 is fed to the antenna 48 for transmission to a nearby communications device 120.

The communications device, at approximately the same time, will be transmitting signals back to the antenna 48. It may do so on a different frequency, or, as is becoming more widespread in practice, on the same frequency as the signal it is receiving by time division multiplexing. The Common Air Interface specification for CT2 telephone systems describes such multiplexing. The communication device's signal is received by the antenna and fed to a second receiver 116 which demodulates and separates all of the received signals. The separated signals are fed back to the system control unit 110 where they are coordinated with the correct telephone lines and sent to a telephone line transmitter 118.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A vending machine for vending a rechargeable battery pack having a means for receiving a payment and generating payment information, a selection entry means for generating selection information, a battery pack storage space, and a means for dispensing said rechargeable battery pack, said vending machine comprising:

control unit having a memory, at least a portion of said memory containing instruction code;

battery pack receiver unit, responsive to said control unit, for accepting a received battery pack, said received battery pack having a voltage level;

test unit, responsive to said control unit, for testing said received battery pack and generating test information, said test information being signaled to said control unit;

recharging unit, responsive to said control unit, for recharging said received battery pack, thereby providing a recharged battery pack;

battery pack handling mechanism, responsive to said control unit, for moving said recharged battery pack to a location in said battery storage space; and wherein said control unit controls the operation of said vending machine according to said instruction code.

2. A vending machine as recited in claim 1, wherein said battery pack receiver unit comprises a battery pack receiver unit port having a battery holder wherein said received battery pack may be inserted.

3. A vending machine as recited in claim 1, wherein said test unit comprises:

voltage measurement means for monitoring said voltage level of said received battery pack;

a load switchably applied to said received battery pack to produce a load response of said voltage level; and wherein said test unit measures said load response of said voltage level to generate said test information.

4. A vending machine as recited in claim 1, wherein said test unit assigns a grade to said received battery pack based on said test information, said grade and said location in said battery storage space are recorded in said memory of said control unit.

5. A vending machine as recited in claim 1, wherein said recharging unit further comprises a discharge regulator whereby said received battery pack may be reconditioned.

6. A vending machine as recited in claim 1, wherein said vending machine is connected to at least one telephone line and further comprising a communications relay station connected to said at least one telephone line for allowing two way wireless communication.

7. A vending machine for vending a rechargeable battery pack, comprising:

control unit having a memory, at least a portion of said memory containing instruction code;

money handling unit, responsive to said control unit, for receiving a payment and generating payment information, said payment information being signaled to said control unit;

interface unit, responsive to said control unit, for displaying alternative operations said vending machine may perform and providing a selection entry means whereby a selection of one of said alternative operations may be entered, thereby generating selection information, said selection information being signaled to said control unit;

battery pack storage space for storing said rechargeable battery pack;

dispensing unit, responsive to said control unit, for moving said rechargeable battery pack from said battery pack storage space to a delivery bin;

battery pack receiver unit, responsive to said control unit, for accepting a received battery pack, said received battery pack having a voltage level;

test unit, responsive to said control unit, for testing said received battery pack and generating test information, said test information being signaled to said control unit;

recharging unit, responsive to said control unit, for recharging said received battery pack, thereby providing a recharged battery pack;

battery pack handling mechanism, responsive to said control unit, for moving said battery pack within said vending machine as directed by said control unit; and wherein said control unit processes said payment, selection, and test information and controls the operation of said vending machine according to said instruction code.

8. A vending machine as recited in claim 7 further comprising a battery recycle bin for storing a received battery pack.

9. A vending machine as recited in claim 7 further comprising a discharge regulator responsive to said control unit and coupled with said recharging unit for discharging said received battery pack wherein said discharge regulator and said recharging unit function cooperatively to recondition said received battery pack.

10. A vending machine as recited in claim 7, wherein said money handling unit comprises a coin slot for receiving coins and a bill slot for receiving bills, wherein said money handling unit accumulates a count of said coins and said bills for generating said payment information.

11. A vending machine as recited in claim 7, wherein said money handling unit comprises a card reader for reading credit and debit cards.

12. A vending machine as recited in claim 7, wherein said interface unit comprises an electronic display.

13. A vending machine as recited in claim 12, wherein said electronic display is a touch screen display whereby said selection of one of said alternative operations may be entered by touching said touch screen display.

14. A vending machine as recited in claim 7, wherein said battery pack receiver unit comprises a battery pack receiver unit port having a battery holder wherein said received battery pack may be inserted.

15. A vending machine as recited in claim 7, wherein said test unit comprises:

voltage measurement means for monitoring said voltage level of said received battery pack;

a load switchably applied to said received battery pack to produce a load response of said voltage level; and wherein said test unit measures said load response of said voltage level to generate said test information.

16. A vending machine as recited in claim 7, wherein said battery pack handling mechanism moves said recharged battery pack to a location in said battery pack storage space, said location in said battery pack storage space being recorded in said memory of said control unit.

17. A vending machine as recited in claim 7, wherein said recharging unit further comprises a discharge regulator whereby said received battery pack may be reconditioned.

18. A vending machine as recited in claim 7, wherein said vending machine is connected to at least one telephone line and further comprising a communications relay station connected to said at least one telephone line for allowing two way wireless communication.

* * * * *